US011106148B2

(12) United States Patent
Noguchi et al.

(10) Patent No.: US 11,106,148 B2
(45) Date of Patent: Aug. 31, 2021

(54) ELECTROSTATIC CHARGE IMAGE DEVELOPMENT TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

(71) Applicant: FUJIFILM Business Innovation Corp., Tokyo (JP)

(72) Inventors: Daisuke Noguchi, Kanagawa (JP); Yuka Yamagishi, Kanagawa (JP); Sakiko Takeuchi, Kanagawa (JP); Kazuhiko Nakamura, Kanagawa (JP); Yutaka Saito, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 16/840,470

(22) Filed: Apr. 6, 2020

(65) Prior Publication Data

US 2021/0088919 A1 Mar. 25, 2021

(30) Foreign Application Priority Data

Sep. 19, 2019 (JP) ..... JP2019-170506

(51) Int. Cl.

| | |
|---|---|
| ***G03G 9/08*** | (2006.01) |
| ***G03G 9/113*** | (2006.01) |
| ***G03G 21/18*** | (2006.01) |
| ***G03G 15/08*** | (2006.01) |
| ***G03G 9/097*** | (2006.01) |

(52) U.S. Cl.

CPC ..... *G03G 9/0819* (2013.01); *G03G 9/0821* (2013.01); *G03G 9/09708* (2013.01); *G03G 9/1138* (2013.01); *G03G 9/1139* (2013.01); *G03G 15/0865* (2013.01); *G03G 21/1814* (2013.01)

(58) Field of Classification Search

CPC ..... G03G 9/09708; G03G 9/1138; G03G 9/1139; G03G 9/0819; G03G 9/0821

USPC ..... 430/108.1

See application file for complete search history.

(56) References Cited

U.S. PATENT DOCUMENTS 3,743,682 A * 7/1973 Crooks ..... G03G 8/00 430/108.1

2007/0218384 A1* 9/2007 Matsumoto ..... G03G 9/0819 430/108.1

FOREIGN PATENT DOCUMENTS

| | | |
|---|---|---|
| JP | 2006317489 | 11/2006 |
| JP | 2009237274 | 10/2009 |

* cited by examiner

*Primary Examiner* — Mark A Chapman

(74) *Attorney, Agent, or Firm* — JCIPRNET

(57) ABSTRACT

An electrostatic charge image development toner that is negatively chargeable contains toner particles and layered-structure compound particles. The layered-structure compound particles have a volume-average particle diameter Da of 0.4 μm or more and less than 3.0 μm. The ratio Da/Db of the volume-average particle diameter Da of the layered-structure compound particles to the volume-average particle diameter Db of the toner particles is 0.044 or more and 0.625 or less.

20 Claims, 3 Drawing Sheets

ELECTROSTATIC CHARGE IMAGE DEVELOPMENT TONER, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2019-170506 filed Sep. 19, 2019.

BACKGROUND

(i) Technical Field

The present disclosure relates to an electrostatic charge image development toner, an electrostatic charge image developer, a toner cartridge, a process cartridge, an image forming apparatus, and an image forming method.

(ii) Related Art

Japanese Unexamined Patent Application Publication No. 2006-317489 discloses a toner that contains a base toner having an average circularity of 0.94 to 0.995 and a volume-average particle diameter of 3 μm to 9 μm and a melamine cyanurate powder having a volume-average particle diameter of 3 μm to 9 μm, wherein the melamine cyanurate powder is present in an amount of 0.1 to 2.0 parts by weight relative to 100 parts by weight of the base toner.

Japanese Unexamined Patent Application Publication No. 2009-237274 discloses a positively chargeable toner that contains colored resin particles containing a binder resin, a coloring agent, and a positive charge controlling agent, and melamine cyanurate particles having a number-average primary particle diameter of 0.05 μm to 1.5 μm, wherein the melamine cyanurate particles are present in an amount of 0.01 to 0.5 parts by weight relative to 100 parts by weight of the colored resin particles.

SUMMARY

Aspects of non-limiting embodiments of the present disclosure relate to an electrostatic charge image development toner that is unlikely to aggregate in a replenishment toner container when the environment is changed from high-temperature and high-humidity to low-temperature and low-humidity compared with an electrostatic charge image development toner containing toner particles and layered-structure compound particles wherein the layered-structure compound particles have a volume-average particle diameter Da of less than 0.4 μm or 3.0 μm or more or the ratio Da/Db of the volume-average particle diameter Da of the layered-structure compound particles to the volume-average particle diameter Db of the toner particles is less than 0.044 or more than 0.625.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an electrostatic charge image development toner that is negatively chargeable and contains toner particles and layered-structure compound particles. The layered-structure compound particles have a volume-average particle diameter Da of 0.4 μm or more and less than 3.0 μm. The ratio Da/Db of the volume-average particle diameter Da of the layered-structure compound particles to a volume-average particle diameter Db of the toner particles is 0.044 or more and 0.625 or less.

BRIEF DESCRIPTION OF THE DRAWINGS

Exemplary embodiments of the present disclosure will be described in detail based on the following figures, wherein.

DETAILED DESCRIPTION

Figure 1:
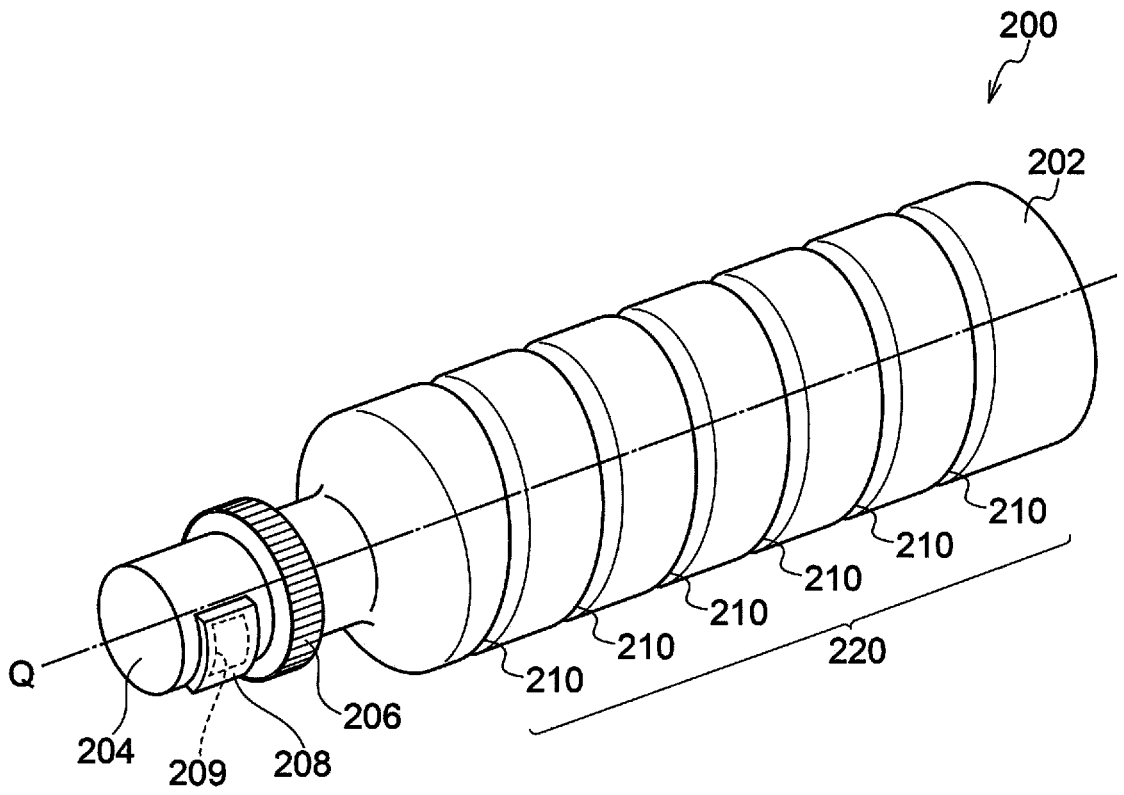
FIG. 1 is a schematic view of an example toner cartridge according to an exemplary embodiment.

Exemplary embodiments of the present disclosure will be described below. The following description and Examples are provided to illustrate exemplary embodiments but are not intended to limit the scope of the exemplary embodiments.

The numerical ranges expressed by using "to" in the present disclosure denote ranges including the numerical values before and after "to" as the minimum value and the maximum value.

The upper limit or the lower limit of one numerical range in stepwise numerical ranges in the present disclosure may be replaced by the upper limit or the lower limit of another stepwise numerical range. The upper limit or the lower limit of any numerical range described in the present disclosure may be replaced by the values described in Examples.

In the present disclosure, the term "step" not only includes an independent step but also includes a step that cannot be clearly distinguished from other steps but may accomplish an intended purpose.

In the description of exemplary embodiments with reference to the drawings in the present disclosure, the structures of the exemplary embodiments are not limited to the structures shown in the drawings. The sizes of the members in each of the drawings are conceptual sizes, and the relative relationship between the sizes of the members is not limited to that shown in the drawings.

In the present disclosure, each component may contain multiple corresponding substances. In the present disclosure, the amount of each component in a composition refers to, when there are multiple substances corresponding to each component in the composition, the total amount of the substances present in the composition, unless otherwise specified.

In the exemplary embodiments, each component may contain multiple types of particles corresponding to each component. The particle diameter of each component refers to, when there are multiple types of particles corresponding to each component in the composition, the particle diameter of a mixture of the multiple types of particles present in the composition, unless otherwise specified.

In the present disclosure, the "electrostatic charge image development toner" is also referred to simply as "toner", and the "electrostatic charge image developer" is also referred to simply as a "developer."

Electrostatic Charge Image Development Toner

A toner according to an exemplary embodiment serves as a replenishment toner to be supplied to a developing unit and is used in an image forming apparatus. The toner according to this exemplary embodiment may be used as a toner to be preloaded into a developing unit.

The toner according to this exemplary embodiment contains toner particles and layered-structure compound particles. The layered-structure compound particles have a volume-average particle diameter Da of 0.4 μm or more and less than 3.0 μm. The ratio Da/Db of the volume-average particle diameter Da of the layered-structure compound particles to the volume-average particle diameter Db of the toner particles is 0.044 or more and 0.625 or less.

The toner according to this exemplary embodiment is unlikely to aggregate in a replenishment toner container when the environment is changed from high-temperature and high-humidity (e.g., a temperature of 28° C. and a relative humidity of 85%) to low-temperature and low-humidity (e.g., a temperature of 22° C. and a relative humidity of 15%). The mechanism for this may be as described below.

Toner may adhere to the inner wall of a replenishment toner container (e.g., toner bottle) to form aggregates. In particular, when a replenishment toner container is a rotary toner bottle, a helical protrusion on the bottle inner wall serves as a means for moving toner to a toner discharge port, and any other toner discharge mechanism (e.g., auger screw) is not disposed inside the bottle in general. Thus, toner tends to adhere to the bottle inner wall to form aggregates.

By the way, toner having layered-structure compound particles (e.g., melamine cyanurate particles, boron nitride particles) as an external additive is known in the related art. Layered-structure compound particles are particles of a compound having a layered structure with an interlayer distance in the order of angstroms. The layers may move relative to each other to exhibit a lubrication effect. The layered-structure compound particles externally added to the toner function as a lubricant between toner particles and between the toner and the inner wall of the replenishment toner container and suppress adhesion of the toner to the inner wall of the replenishment toner container and the associated aggregation. However, under the conditions where the environment is changed from high-temperature and high-humidity to low-temperature and low-humidity, condensation may occur on the inner wall of the replenishment toner container, and the toner may adhere to the inner wall to form aggregates.

When the layered-structure compound particles have a particle diameter in a suitable range, and the ratio of the particle diameter of the layered-structure compound particles to the particle diameter of the toner particles is in a suitable range, the layered-structure compound particles may more effectively exhibit a lubrication effect. This may prevent adhesion of the toner to the inner wall of the replenishment toner container and formation of aggregates even under the conditions where the environment is changed from high-temperature and high-humidity to low-temperature and low-humidity.

If the layered-structure compound particles have a volume-average particle diameter Da of less than 0.4 μm, the distance by which the layers move relative to each other may be short, and the lubrication effect of each layered-structure compound particle may be insufficient. To improve the lubrication effect of each layered-structure compound particle, the volume-average particle diameter Da of the layered-structure compound particles is 0.4 μm or more, preferably 0.45 μm or more, and more preferably 0.5 μm or more.

If the layered-structure compound particles have a volume-average particle diameter Da of 3.0 μm or more, the layered-structure compound particles may easily be detached from the toner particle surface, and the lubrication effect to be exhibited between the toner particles and between the toner and the inner wall of the replenishment toner container may be reduced. To cause the layered-structure compound particles to stay on the toner particle surface and to exhibit a lubrication effect, the volume-average particle diameter Da of the layered-structure compound particles is less than 3.0 μm, preferably 2.7 μm or less, and more preferably 2.5 μm or less.

If the ratio Da/Db of the volume-average particle diameter Da of the layered-structure compound particles to the volume-average particle diameter Db of the toner particles is less than 0.044, the layered-structure compound particles are too small relative to the toner particles, and the layered-structure compound particles may be buried in the toner particle surface so that the layered-structure compound particles are unlikely to exhibit a lubrication effect. To prevent the layered-structure compound particles from being buried in the toner particle surface, the ratio Da/Db is 0.044 or more, preferably 0.056 or more, and more preferably 0.060 or more.

If the ratio Da/Db of the volume-average particle diameter Da of the layered-structure compound particles to the volume-average particle diameter Db of the toner particles is more than 0.625, the layered-structure compound particles are too large relative to the toner particles, and the layered-structure compound particles may be unlikely to enter between the toner particles. To cause the layered-structure compound particles to enter between the toner particles and to exhibit a lubrication effect, the ratio Da/Db is 0.625 or less, preferably 0.580 or less, and more preferably 0.540 or less.

The layered-structure compound particles are normally positively chargeable. Thus, when the toner particles are negatively chargeable, the layered-structure compound particles tend to stay on the toner particle surface. In the toner according to this exemplary embodiment, the toner particles are negatively chargeable, and the entire toner is negatively chargeable.

In the exemplary embodiment, the negatively chargeable toner means that, when the toner charge amount is measured in accordance with the toner charge amount measuring method standard according to the carrier by using four standard carriers (N-01, N-02, P-01, P-02) distributed by General Incorporated Association, the Imaging Society of Japan, the toner is negatively chargeable as measured by using any of the four standard carriers.

Specifically, the toner charge amount is measured as described below.

The charge amount is measured after 6 parts by mass of toner and 100 parts by mass of standard carrier are stirred in a ball mill for 10 minutes. The relationship between triboelectric series of standard carriers and charging in using standard carriers is subjected to linear regression, toner whose charge at a point where triboelectric series of standard carriers show zero charge is larger than zero is determined to be positively chargeable, and toner whose charge at this point is smaller than zero is determined to be negatively chargeable.

The components, configuration, and features of the toner according to this exemplary embodiment will be described below in detail.

Toner Particles

The toner particles contain, for example, a binder resin and, as necessary, a coloring agent, a release agent, and other additives.

Binder Resin

Examples of the binder resin include vinyl resins composed of a homopolymer of a monomer or a copolymer of two or more monomers of, for example, styrenes (e.g., styrene, p-chlorostyrene, α-methylstyrene), (meth)acrylic acid esters (e.g., methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate), ethylenically unsaturated nitriles (e.g., acrylonitrile, methacrylonitrile), vinyl ethers (e.g., vinyl methyl ether, vinyl isobutyl ether), vinyl ketones (e.g., vinyl methyl ketone, vinyl ethyl ketone, vinyl isopropenyl ketone), and olefins (e.g., ethylene, propylene, butadiene).

Examples of the binder resin include non-vinyl resins, such as epoxy resins, polyester resins, polyurethane resins, polyamide resins, cellulose resins, polyether resins, and modified rosins; and mixtures of these non-vinyl resins and the above vinyl resins, and graft polymers obtained by polymerization of a vinyl monomer in the presence of these non-vinyl resins.

These binder resins may be used alone or in combination of two or more.

The binder resin may be a polyester resin.

Examples of the polyester resin include known amorphous polyester resins. The polyester resin may be a combination of amorphous polyester resin and crystalline polyester resin. The crystalline polyester resin may be used in an amount in a range of 2 mass % or more and 40 mass % or less (preferably 2 mass % or more and 20 mass % or less) relative to the entire binder resin.

The term "crystalline" regarding resin means that the resin shows a distinct endothermic peak rather than stepwise endothermic changes as measured by differential scanning calorimetry (DSC) and specifically means that the full width at half maximum of the endothermic peak in measuring at a heating rate of 10 (° C./min) is within 10° C.

The term "amorphous" regarding resin means that the resin shows a full width at half maximum of more than 10° C., shows stepwise endothermic changes, or shows no distinct endothermic peak.

Amorphous Polyester Resin

Examples of the amorphous polyester resin include polycondensation polymers of a polycarboxylic acid and a polyhydric alcohol. The amorphous polyester resin may be a commercial product or a synthetic product.

Examples of the polycarboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, naphthalene dicarboxylic acid), anhydrides thereof, and lower (e.g., 1 or more and 5 or less carbon atoms) alkyl esters thereof. Among these, the polycarboxylic acid is preferably, for example, an aromatic dicarboxylic acid.

The polycarboxylic acid may be a combination of a dicarboxylic acid and a trivalent or higher valent carboxylic acid having a crosslinked structure or branched structure. Examples of the trivalent or higher valent carboxylic acid include trimellitic acid, pyromellitic acid, anhydrides thereof, and lower (e.g., 1 or more and 5 or less carbon atoms) alkyl esters thereof.

The polycarboxylic acid may be used alone or in combination of two or more.

Examples of the polyhydric alcohol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexane dimethanol, hydrogenated bisphenol A), aromatic diols (e.g., an ethylene oxide adduct of bisphenol A, and a propylene oxide adduct of bisphenol A). Among these, the polyhydric alcohol is preferably, for example, an aromatic diol or an alicyclic diol, and more preferably an aromatic diol.

The polyhydric alcohol may be a combination of a diol and a trihydric or higher polyhydric alcohol having a crosslinked structure or branched structure. Examples of the trihydric or higher polyhydric alcohol include glycerol, trimethylolpropane, and pentaerythritol.

The polyhydric alcohol may be used alone or in combination of two or more.

The glass transition temperature (Tg) of the amorphous polyester resin is preferably 50° C. or higher and 80° C. or lower, and more preferably 50° C. or higher and 65° C. or lower.

The glass transition temperature is determined from the DSC curve obtained by differential scanning calorimetry (DSC) and, more specifically, determined in accordance with "extrapolated glass transition onset temperature" described in the method for determining the glass transition temperature in JIS K 7121:1987 "Testing Methods for Transition Temperatures of Plastics".

The weight-average molecular weight (Mw) of the amorphous polyester resin is preferably 5000 or more and 1,000,000 or less, and more preferably 7,000 or more and 500,000 or less.

The number-average molecular weight (Mn) of the amorphous polyester resin is preferably 2,000 or more and 100,000 or less.

The molecular weight distribution Mw/Mn of the amorphous polyester resin is preferably 1.5 or more and 100 or less, and more preferably 2 or more and 60 or less.

The weight-average molecular weight and the number-average molecular weight are determined by gel permeation chromatography (GPC). The determination of the molecular weight by GPC is carried out by using HLC-8120GPC, which is a GPC available from Tosoh Corporation and used as a measurement system, TSKgel SuperHM-M (15 cm), which is a column available from Tosoh Corporation, and a THF solvent. The weight-average molecular weight and the number-average molecular weight are calculated from the molecular weight calibration curve created on the basis of the obtained measurement results using a monodisperse polystyrene standard.

The amorphous polyester resin is produced by using a known manufacturing method. Specifically, the amorphous polyester resin is produced by using a method involving causing reaction at a polymerization temperature of 180° C. or higher and 230° C. or lower in a reaction system, as necessary, under reduced pressure while water and alcohol generated during condensation are removed.

If the monomers serving as raw materials are neither dissolved in nor compatible with each other at a reaction temperature, a solvent with a high boiling point may be added as a solubilizer to form a solution. In this case, the polycondensation reaction is carried out while the solubilizer is distilled off. If a monomer with poor compatibility is present in the copolymerization reaction, the monomer with poor compatibility is previously subjected to condensation with an acid or alcohol that is to undergo polycondensation with the monomer, and the condensate is then subjected to polycondensation with a main component.

Crystalline Polyester Resin

Examples of the crystalline polyester resin include polycondensates of a polycarboxylic acid and a polyhydric alcohol. The crystalline polyester resin may be a commercial product or a synthetic product.

The crystalline polyester resin is preferably a polycondensate produced by using a straight-chain aliphatic polymerizable monomer rather than a polymerizable monomer having an aromatic ring in order to easily form the crystal structure.

Examples of the polycarboxylic acid include aliphatic dicarboxylic acids (e.g., oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid), aromatic dicarboxylic acids (e.g., dibasic acids, such as phthalic acid, isophthalic acid, terephthalic acid, and naphthalene-2,6-dicarboxylic acid), anhydrides thereof, and lower (e.g., 1 or more and 5 or less carbon atoms) alkyl esters thereof.

The polycarboxylic acid may be a combination of a dicarboxylic acid and a trivalent or higher valent carboxylic acid having a crosslinked structure or branched structure. Examples of the trivalent carboxylic acid include aromatic carboxylic acids (e.g., 1,2,3-benzenetricarboxylic acid, 1,2,4-benzenetricarboxylic acid, and 1,2,4-naphthalenetricarboxylic acid), anhydrides thereof, and lower (e.g., 1 or more and 5 or less carbon atoms) alkyl esters thereof.

The polycarboxylic acid may be a combination of these dicarboxylic acids and a dicarboxylic acid having a sulfonic acid group or a dicarboxylic acid having an ethylenic double bond.

The polycarboxylic acid may be used alone or in combination of two or more.

Examples of the polyhydric alcohol include aliphatic diols (e.g., straight-chain aliphatic diols having 7 to 20 carbon atoms in the main chain). Examples of aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosandecanediol. Among these, aliphatic diols are preferably 1,8-octanediol, 1,9-nonanediol, and 1,10-decanediol.

The polyhydric alcohol may be a combination of a diol and a trihydric or higher alcohol having a crosslinked structure or branched structure. Examples of the trihydric or higher alcohol include glycerol, trimethylolethane, trimethylolpropane, and pentaerythritol.

The polyhydric alcohol may be used alone or in combination of two or more.

The polyhydric alcohol preferably includes 80 mol % or more of an aliphatic diol and more preferably includes 90 mol % or more of an aliphatic diol.

The melting temperature of the crystalline polyester resin is preferably 50° C. or higher and 100° C. or lower, more preferably 55° C. or higher and 90° C. or lower, and still more preferably 60° C. or higher and 85° C. or lower.

The melting temperature is determined from the DSC curve obtained by differential scanning calorimetry (DSC) in accordance with "melting peak temperature" described in the method for determining the melting temperature in JIS K 7121:1987 "Testing Methods for Transition Temperatures of Plastics".

The weight-average molecular weight (Mw) of the crystalline polyester resin is preferably 6,000 or more and 35,000 or less.

The crystalline polyester resin is produced by, for example, a known manufacturing method, like amorphous polyester.

The amount of the binder resin is preferably 40 mass % or more and 95 mass % or less, more preferably 50 mass % or more and 90 mass % or less, and still more preferably 60 mass % or more and 85 mass % or less relative to the entire toner particles.

Coloring Agent

Examples of the coloring agent include pigments, such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, DuPont oil red, pyrazolone red, lithol red, rhodamine B lake, lake red C, pigment red, rose bengal, aniline blue, ultramarine blue, calco oil blue, methylene blue chloride, phthalocyanine blue, pigment blue, phthalocyanine green, malachite green oxalate; and dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The coloring agent may be used alone or in combination of two or more.

The coloring agent may be a surface-treated coloring agent as necessary and may be used in combination with a dispersant. The coloring agent may be used in combination of two or more.

The amount of the coloring agent is preferably 1 mass % or more and 30 mass % or less, and more preferably 3 mass % or more and 15 mass % or less relative to the entire toner particles.

Release Agent

Examples of the release agent include hydrocarbon waxes; natural waxes, such as carnauba wax, rice wax, and candelilla wax; synthetic or mineral and petroleum waxes, such as montan wax; and ester waxes, such as waxes of fatty acid esters and montanic acid esters. The release agent is not limited to these.

The melting temperature of the release agent is preferably 50° C. or higher and 110° C. or lower, and more preferably 60° C. or higher and 100° C. or lower.

The melting temperature is determined from the DSC curve obtained by differential scanning calorimetry (DSC) in accordance with "melting peak temperature" described in the method for determining the melting temperature in JIS K 7121:1987 "Testing Methods for Transition Temperatures of Plastics".

The amount of the release agent is preferably 1 mass % or more and 20 mass % or less, and more preferably 5 mass % or more and 15 mass % or less relative to the entire toner particles.

Other Additives

Examples of other additives include known additives, such as magnetic substances, charge control agents, and inorganic powders. These additives are internal additives and contained in the toner particles.

Properties of Toner Particles and Like

The toner particles may be toner particles having a single-layer structure, or may be toner particles having so-called a core-shell structure including a core part (core particle) and a coating layer (shell layer) covering the core part.

The toner particles having a core-shell structure include, for example, a core part containing a binder resin and as necessary, other additives such as a coloring agent and a release agent; and a coating layer containing a binder resin.

The volume-average particle diameter Db of the toner particles is preferably 4 μm or more and 9 μm or less, more preferably 4 μm or more and 8 μm or less, and still more preferably 4 μm or more and 7 μm or less.

The volume-average particle diameter Db of the toner particles is measured by using Coulter Multisizer II (available from Beckman Coulter, Inc.) and an electrolyte ISOTON-II (available from Beckman Coulter, Inc.). Before measurement, 0.5 mg or more and 50 mg or less of a test sample is added to 2 ml of a 5 mass % aqueous solution of a surfactant (e.g., sodium alkylbenzene sulfonate) serving as a dispersant. The mixture is added to 100 ml or more and 150 ml or less of the electrolyte.

The electrolyte in which the sample is suspended is subjected to a dispersion treatment using an ultrasonic disperser for 1 minute, and the particle diameter of particles having a particle diameter in the range of 2 μm or more and 60 μm or less is measured by Coulter Multisizer II with an aperture having a diameter of 100 μm. The number of sampled particles is 50,000. The volume-based cumulative distribution of the particle diameter is drawn from the smaller particle diameter side, and the particle diameter at a cumulative percentage of 50% is defined as a volume-average particle diameter Db.

The average circularity of the toner particles is preferably 0.94 or more and 1.00 or less, and more preferably 0.95 or more and 0.98 or less.

The average circularity of the toner particles is obtained from (circle equivalent circumference)/(circumference) [circumference of circle having the same projected area as particle image]/(circumference of projected particle image)]. Specifically, the average circularity of the toner particles is a value determined by the following method.

First, the toner particles to be analyzed are collected by suction to form a flat flow, and particle images are captured with stroboscopic flash to obtain still images. The particle images are analyzed with a flow particle image analyzer (FPIA-3000 available from Sysmex Corporation) to determine average circularity. The number of samples used to determine the average circularity is 3,500.

When the toner has an external additive, the toner (developer) to be analyzed is dispersed in surfactant-containing water and then subjected to ultrasonication to prepare toner particles having no external additive.

Layered-Structure Compound Particles

The layered-structure compound particles are particles of a compound having a layered structure. Examples of the layered-structure compound particles include melamine cyanurate particles, boron nitride particles, graphite fluoride particles, molybdenum disulfide particles, and mica particles.

To reduce toner aggregation, the volume-average particle diameter Da of the layered-structure compound particles is 0.4 μm or more and less than 3.0 μm, preferably 0.45 μm or more and 2.7 μm or less, and more preferably 0.5 μm or more and 2.5 μm or less. The volume-average particle diameter of the layered-structure compound particles can be controlled by grinding, sizing, or a combination of grinding and sizing.

The volume-average particle diameter Da of the layered structure compound is determined by the following measurement method.

First, the layered-structure compound particles are separated from the toner. A method for separating the layered-structure compound particles from the toner is not limited. For example, a dispersion in which toner is dispersed in surfactant-containing water is exposed to ultrasonic waves and then subjected to high-speed centrifugation to separate between toner particles, the layered-structure compound particles, and other external additives by virtue of specific gravity. The fraction containing the layered-structure compound particles is extracted and dried to provide layered-structure compound particles.

Next, the layered-structure compound particles are added to an electrolyte aqueous solution (Isoton aqueous solution) and dispersed therein by exposure to ultrasonic waves for 30 seconds or longer. This dispersion is used as a sample, and the particle diameter is measured by using a laser diffraction/scattering particle diameter distribution analyzer (e.g., Microtrac MT3000 II available from MicrotracBEL Corporation). At least 3000 layered-structure compound particles are measured, and the particle diameter at a cumulative percentage of 50% from the smaller particle diameter side in the volume-based particle diameter distribution is defined as a volume-average particle diameter Da.

To reduce toner aggregation, the amount of the layered-structure compound particles is preferably 0.01 mass % or more and 1.0 mass % or less, more preferably 0.01 mass % or more and 0.90 mass % or less, and still more preferably 0.01 mass % or more and 0.85 mass % or less relative to the entire toner.

External Additives Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

The surfaces of the inorganic particles serving as an external additive may be hydrophobized. The hydrophobization treatment is performed by, for example, immersing the inorganic particles in a hydrophobizing agent. Examples of the hydrophobizing agent include, but are not limited to, a silane coupling agent, a silicone oil, a titanate coupling agent, and an aluminum coupling agent. These hydrophobizing agents may be used alone or in combination of two or more. The amount of the hydrophobizing agent is normally, for example, 1 part by mass or more and 10 parts by mass or less relative to 100 parts by mass of the inorganic particles.

Examples of the external additive also include resin particles (resin particles made of, for example, polystyrene, polymethyl methacrylate, and melamine resin), and cleaning active agents (e.g., higher fatty acid metal salts represented by zinc stearate, particles made of fluorocarbon polymers).

The amount of the external additive externally added is, for example, 0.01 mass % or more and 5 mass % or less, and more preferably 0.01 mass % or more and 2.0 mass % or less relative to the toner particles.

Method for Manufacturing Toner

The toner according to this exemplary embodiment is obtained by externally adding an external additive to toner particles after the toner particles are manufactured.

The toner particles may be manufactured by using any one of dry manufacturing methods (e.g., kneading-pulverization method) and wet manufacturing methods (e.g., aggregation-coalescence method, suspension-polymerization method, and dissolution-suspension method). The method is not limited to these manufacturing methods, and a known manufacturing method is employed. Among these methods, an aggregation-coalescence method may be used to produce the toner particles.

Specifically, for example, when the toner particles are manufactured by using an aggregation-coalescence method, the toner particles are manufactured through the following steps: a step (resin particle dispersion preparing step) of preparing a resin particle dispersion in which resin particles serving as a binder resin are dispersed; a step (aggregated particle forming step) of aggregating the resin particles (and other particles as necessary) in the resin particle dispersion (in a dispersion obtained by mixing the resin particle dispersion with other particle dispersion as necessary) to form aggregated particles; and a step (fusion-coalescence step) of heating an aggregated particle dispersion in which the aggregated particles are dispersed, causing fusion and coalescence of the aggregated particles to form toner particles.

Each step will be described below in detail.

The following description provides a method for producing toner particles containing a coloring agent and a release agent, but the coloring agent and the release agent are used as necessary. It is understood that additives other than the coloring agent and the release agent may be used.

Resin Particle Dispersion Preparing Step

In addition to a resin particle dispersion in which resin particles serving as a binder resin are dispersed, for example, a coloring agent particle dispersion in which coloring agent particles are dispersed, and a release agent particle dispersion in which release agent particles are dispersed are prepared.

The resin particle dispersion is prepared by, for example, dispersing resin particles in a dispersion medium using a surfactant.

Examples of the dispersion medium used in the resin particle dispersion include aqueous media.

Examples of aqueous media include water such as distilled water and ion exchange water and alcohols. These aqueous media may be used alone or in combination of two or more.

Examples of the surfactant include anionic surfactants, such as sulfate surfactants, sulfonate surfactants, phosphate surfactants, and soap surfactants; cationic surfactants, such as amine salt surfactants and quaternary ammonium salt surfactants; and nonionic surfactants, such as polyethylene glycol surfactants, alkylphenol ethylene oxide adduct surfactants, and polyhydric alcohol surfactants. Among these surfactants, in particular, anionic surfactants and cationic surfactants may be used. A nonionic surfactant may be used in combination with an anionic surfactant or a cationic surfactant.

The surfactants may be used alone or in combination of two or more.

Examples of a method for dispersing resin particles in a dispersion medium to prepare the resin particle dispersion include ordinary dispersion methods using a rotary shear homogenizer, a ball mill having media, a sand mill, and Dyno-Mill. Depending on the type of resin particles, the resin particles may be dispersed in the dispersion medium by a phase-inversion emulsification method. The phase-inversion emulsification method is a method for dispersing a resin in the form of particles in an aqueous medium. This method involves dissolving a target resin in a hydrophobic organic solvent capable of dissolving the resin; adding a base to the organic continuous phase (O phase) to cause neutralization; and then adding an aqueous medium (W phase) to cause phase inversion from W/O to O/W.

The volume-average particle diameter of the resin particles dispersed in the resin particle dispersion is preferably 0.01 μm or more and 1 μm or less, more preferably 0.08 μm or more and 0.8 μm or less, and still more preferably 0.1 μm or more and 0.6 μm or less.

The volume-average particle diameter of the resin particles is determined as follows: drawing the volume-based cumulative distribution in divided particle diameter ranges (channels) from the smaller particle diameter side using the particle diameter distribution obtained by measurement with a laser diffraction particle diameter distribution measuring device (e.g., LA-700 available from Horiba Ltd.); and defining the particle diameter at a cumulative percentage of 50% relative to all particles as a volume-average particle diameter D50v. The volume-average particle diameter of particles in other dispersions is determined similarly.

The amount of the resin particles in the resin particle dispersion is preferably 5 mass % or more and 50 mass % or less, and more preferably 10 mass % or more and 40 mass % or less.

Similarly to the resin particle dispersion, for example, the coloring agent particle dispersion and the release agent particle dispersion are also prepared. Specifically, the volume-average particle diameter of the particles, the dispersion medium, the dispersion method, and the amount of the particles for the resin particle dispersion are the same as those for the coloring agent particles dispersed in the coloring agent particle dispersion and the release agent particles dispersed in the release agent particle dispersion.

Aggregated Particle Forming Step

Next, the resin particle dispersion is mixed with the coloring agent particle dispersion and the release agent particle dispersion.

The resin particles, the coloring agent particles, and the release agent particles cause hetero-aggregation in the mixture dispersion to form aggregated particles having a size close to the intended toner particle diameter and containing the resin particles, the coloring agent particles, and the release agent particles.

Specifically, the aggregated particles are formed, for example, as follows: adding a flocculant to the mixture dispersion and adjusting the pH of the mixture dispersion to the acid side (e.g., pH 2 or higher and pH 5 or lower), and as necessary, adding a dispersion stabilizer; and then heating the mixture dispersion to a temperature close to the glass transition temperature of the resin particles (specifically, heating to, for example, the glass transition temperature of the resin particles minus 30° C. or higher and the glass transition temperature minus 10° C. or lower) to cause aggregation of the particles dispersed in the mixture dispersion.

The aggregated particle forming step may involve, for example, adding a flocculant to the mixture dispersion at room temperature (e.g., 25° C.) under stirring with a rotary shear homogenizer and adjusting the pH of the mixture dispersion to the acid side (e.g., pH 2 or higher and pH 5 or lower), and heating the mixture dispersion after addition of a dispersion stabilizer as necessary.

Examples of the flocculant include surfactants having polarity opposite to the polarity of the surfactant contained in the mixture dispersion, inorganic metal salts, and divalent or higher valent metal complexes. The use of a metal complex as a flocculant reduces the amount of the surfactant used and improves charging characteristics.

The flocculant may be used in combination with an additive that forms a complex or a similar bond with metal ions of the flocculant, as necessary. The additive may be a chelating agent.

Examples of inorganic metal salts include metal salts, such as calcium chloride, calcium nitrate, barium chloride, magnesium chloride, zinc chloride, aluminum chloride, and aluminum sulfate; and inorganic metal salt polymers, such as polyaluminum chloride, polyaluminum hydroxide, and calcium polysulfide.

The chelating agent may be a water-soluble chelating agent. Examples of the chelating agent include oxycarboxylic acids, such as tartaric acid, citric acid, and gluconic acid; and aminocarboxylic acids, such as iminodiacetic acid (IDA), nitrilotriacetic acid (NTA), and ethylenediaminetetraacetic acid (EDTA).

The amount of the chelating agent added is preferably 0.01 parts by mass or more and 5.0 parts by mass or less and more preferably 0.1 parts by mass or more and 3.0 parts by mass or less relative to 100 parts by mass of the resin particles.

Fusion-Coalescence Step

Next, the aggregated particle dispersion in which the aggregated particles are dispersed is heated to, for example, a temperature not lower than the glass transition temperature of the resin particles (e.g., a temperature higher than the glass transition temperature of the resin particles by 10° C. to 30° C.) to cause fusion and coalescence of the aggregated particles and thus to form toner particles.

The toner particles are produced through the above-described steps.

The toner particles may be manufactured through the following steps: a step of preparing an aggregated particle dispersion in which aggregated particles are dispersed, and then mixing the aggregated particle dispersion and a resin particle dispersion in which resin particles are dispersed, to cause aggregation such that the resin particles adhere to the surfaces of the aggregated particles and thus to form secondary aggregated particles; and a step of heating a secondary aggregated particle dispersion in which the secondary aggregated particles are dispersed, to cause fusion and coalescence of the secondary aggregated particles and thus to form toner particles having a core-shell structure.

After completion of the fusion-coalescence step, the toner particles formed in the dispersion are subjected to a known washing step, a known solid-liquid separation step, and a known drying step to provide dry toner particles. The washing step may involve sufficient displacement washing with ion exchange water in view of charging characteristics. The solid-liquid separation step may involve, for example, suction filtration or pressure filtration in view of productivity. The drying step may involve, for example, freeze drying, flush drying, fluidized bed drying, or vibratory fluidized bed drying in view of productivity.

The toner according to this exemplary embodiment is manufactured by, for example, adding an external additive to the obtained dry toner particles and mixing them. Mixing may be performed with, for example, a V-blender, a Henschel mixer, or a Lodige mixer. In addition, coarse particles in the toner may be removed with, for example, a vibratory screening machine, a wind-power screening machine, as necessary.

Electrostatic Charge Image Developer

A electrostatic charge image developer according to an exemplary embodiment contains at least the toner according to this exemplary embodiment.

The electrostatic charge image developer according to this exemplary embodiment may be a one-component developer containing only the toner according to this exemplary embodiment, or may be a two-component developer formed by mixing the toner and a carrier.

The carrier is not limited, and may be any known carrier. Examples of the carrier include a coated carrier obtained by coating, with resin, the surfaces of cores formed of magnetic powder; a magnetic powder-dispersed carrier in which magnetic powder is dispersed in a matrix resin; and a resin-impregnated carrier in which porous magnetic powder is impregnated with resin. The magnetic powder-dispersed carrier and the resin-impregnated carrier may be carriers in which the surfaces of carrier-forming particles serving as cores are coated with resin.

Examples of the magnetic powder include powders made of magnetic metals, such as iron, nickel, and cobalt; and powders made of magnetic oxides, such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid ester copolymer, a straight silicone resin including an organosiloxane bond, and modified products thereof, fluorocarbon resin, polyester, polycarbonate, phenolic resin, and epoxy resin. The coating resin and the matrix resin may contain other additives, such as conductive particles. Examples of the conductive particles include particles made of metals, such as gold, silver, and copper; and particles made of carbon black, titanium oxide, zinc oxide, tin oxide, barium sulfate, aluminum borate, and potassium titanate.

To coat the surfaces of cores with resin, for example, a coating method using a coating-layer forming solution in which a coating resin and various additives (as necessary) are dissolved in an appropriate solvent is used. The solvent is not limited and may be selected in consideration of the type of resin used, coating suitability, and the like.

Specific examples of the resin coating method include an immersion method that involves immersing cores in a coating-layer forming solution; a spray method that involves spraying a coating-layer forming solution onto the surfaces of cores; a fluidized bed method that involves spraying a coating-layer forming solution to cores while the cores are floating in air flow; and a kneader-coater method that involves mixing carrier cores and a coating-layer forming solution in a kneader-coater, and then removing a solvent.

The mixing ratio (mass ratio) of the toner to the carrier in the two-component developer is preferably from 1:100 to 30:100 (=toner:carrier), and more preferably from 3:100 to 20:100.

Toner Cartridge

A toner cartridge according to an exemplary embodiment contains the toner according to this exemplary embodiment. The toner cartridge is attachable to and detachable from an image forming apparatus. The toner cartridge contains toner for replenishment to be supplied to a developing unit in the image forming apparatus.

An example of the toner cartridge according to this exemplary embodiment is a rotary toner cartridge having a rotary body containing the toner. FIG. 1 is a schematic structural view of a rotary toner bottle, which is an example rotary toner cartridge. A rotary toner bottle 200 shown in FIG. 1 includes a bottle body 202, a cap 204, and a gear 206.

The bottle body 202 has a cylindrical shape and has, on the side surface, a protrusion-recess section 220 for moving a replenishment toner to a discharge port. A protrusion 210 in the protrusion-recess section 220 extends helically and continuously from near the bottom surface of the bottle body 202 toward the cap 204. The protrusion 210 is formed in a protrusion shape as viewed from the inside of the bottle body 202. The protrusion 210 may include one helical ridge or may have two or more helical ridges. A section between adjacent turns of the protrusion 210 has a recess shape as viewed from the inside of the bottle body 202. The width (the length in the axis direction Q) of the protrusion 210 may be smaller than the width (the length in the axis direction Q) of the recess section adjacent to the protrusion 210 in order to facilitate movement of the replenishment toner inside the bottle body 202 toward the cap 204.

The bottle body 202 is made of, for example, resin. Examples of the material of the bottle body 202 include polyethylene terephthalate, polyolefin, and polyester. The bottle body 202 may be integral with the gear 206. Alternatively, the bottle body 202 and the gear 206 may be molded separately, and the molded products may be combined together.

The cap 204 is disposed at the one end side of the rotary toner bottle 200 in the axis direction Q. The cap 204 has a discharge port 209 for discharging the replenishment toner and a shutter 208 for opening and closing the discharge port 209. The discharge port 209 is opened and closed by opening and closing the shutter 208.

When the rotary toner bottle 200 is installed into a toner cartridge installation unit of the image forming apparatus, the gear 206 engages with a driving gear of the toner cartridge installation unit and is driven by driving the driving gear. The gear 206 is concentric with the bottle body 202. The outer diameter of the gear 206 shown in FIG. 1 is smaller than the outer diameter of the bottle body 202. The outer diameter of the gear 206 may be the same as that of the bottle body 202 or may be larger than the outer diameter of the bottle body 202.

Although FIG. 1 shows a form in which the bottle body 202 has the protrusion-recess section 220, the toner cartridge and the rotary toner bottle according to this exemplary embodiment are not limited to this form. The side surface of the bottle body 202 may be a flat curved surface without a recess, as viewed from the outside of the bottle body 202.

Although FIG. 1 shows a form in which the protrusion 210 is part of the bottle body 202, the toner cartridge and the rotary toner bottle according to this exemplary embodiment are not limited to this form. The protrusion 210 may be a member separate from the bottle body 202. The separate member is, for example, a coil member that is disposed in contact with the internal surface of the bottle body 202 and that extends helically and continuously from near the bottom surface of the bottle body 202 toward the cap 204.

Next, an operation performed when the rotary toner bottle 200 is installed into the toner cartridge installation unit of the image forming apparatus will be described.

The rotary toner bottle 200 is installed into the toner cartridge installation unit such that the gear 206 engages with the driving gear of the toner cartridge installation unit. At this time, the shutter 208 is opened, and the rotary toner bottle 200 communicates with the toner replenishment path of the image forming apparatus through the discharge port 209. As the driving gear of the toner cartridge installation unit rotates, the gear 206 is driven to rotate, and the bottle body 202 is driven to rotate about the axis direction Q which serves as a central axis. As the bottle body 202 is driven to rotate, the replenishment toner moves from the bottom surface side of the bottle body 202 toward the cap 204 by virtue of the protrusion-recess section 220. The replenishment toner that has moved toward the cap 204 is discharged from the discharge port 209 and is supplied to the toner replenishment path of the image forming apparatus. The rotary toner bottle 200 is, for example, installed into the toner cartridge installation unit of the image forming apparatus such that the axis direction Q corresponds to the horizontal direction.

Process Cartridge

A process cartridge according to an exemplary embodiment is a process cartridge attachable to and detachable from an image forming apparatus. The process cartridge includes: a developing unit that contains an electrostatic charge image developer and develops an electrostatic charge image on a surface of an image holding member by using the electrostatic charge image developer to form a toner image; a toner cartridge that contains the electrostatic charge image development toner according to this exemplary embodiment; and a toner replenishment path that connects between the toner cartridge and the developing unit and through which the developing unit is replenished with the electrostatic charge image development toner in the toner cartridge.

The process cartridge according to this exemplary embodiment may include a developing unit, a toner cartridge, a toner replenishment path, and as necessary, at least one selected from an image holding member, a charging unit, an electrostatic charge image forming unit, a transfer unit, and the like.

An example of the process cartridge according to this exemplary embodiment will be described below, but this exemplary embodiment is not limited to this example.

Figure 2:
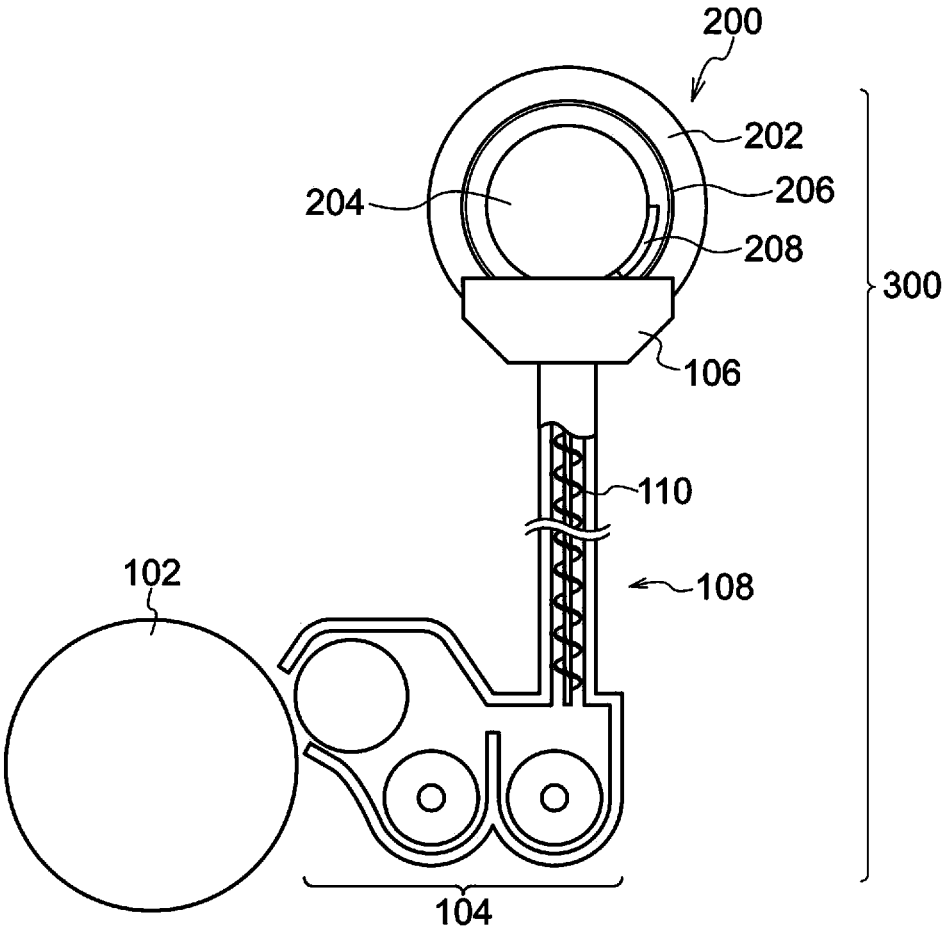
FIG. 2 is a schematic view of an example process cartridge according to an exemplary embodiment.

FIG. 2 is a schematic view of an example of the process cartridge according to this exemplary embodiment. The process cartridge 300 shown in FIG. 2 is, for example, attached to and detached from the image forming apparatus shown in FIG. 3.

The process cartridge 300 includes a developing device 104 (an example of the developing unit), a toner replenishment path 108, and a toner cartridge 200. FIG. 2 also shows a photoreceptor 102 (an example of the image holding member) disposed adjacent to the process cartridge 300 when the process cartridge 300 is installed into the image forming apparatus.

The developing device 104, for example, includes two chambers with a partition member therebetween. One chamber has an outlet of the toner replenishment path 108, and the other chamber includes a developing roller that faces the photoreceptor 102. The two chambers are partly connected to each other, and each chamber includes one stirring member that stirs and transports a developer. The developer (not shown) in the developing device 104 is stirred and transported by two stirring members and supplied to the developing roller.

The toner replenishment path 108 has the toner cartridge installation unit 106 at one end, and the other end is connected to the developing device 104. An auger screw 110, which is an example toner transport mechanism, is disposed inside the toner replenishment path 108. The operation of the auger screw 110 causes toner to pass through the toner replenishment path 108. A toner transport mechanism, such as an auger screw, is not necessarily disposed inside the toner replenishment path 108. In this case, for example, the toner passes through the toner replenishment path 108 by free fall.

The toner cartridge installation unit 106 is a unit for detachably installing the toner cartridge 200 into the image forming apparatus. The toner cartridge installation unit 106 includes a toner receiving port that communicates with a toner discharge port of the toner cartridge 200, and a rotation mechanism (e.g., gear) that causes the toner cartridge 200 to rotate.

The toner cartridge 200 contains the electrostatic charge image development toner according to this exemplary embodiment as a replenishment toner with which the developing device 104 is to be replenished. The toner cartridge 200 is, for example, a rotary toner bottle (an example of the toner cartridge) and includes the bottle body 202, the cap 204, the gear 206, and the shutter 208 that opens and closes the toner discharge port. Some specific forms of the structure and operation of the toner cartridge 200 are similar to those of the rotary toner bottle 200.

The toner cartridge 200 is, for example, installed into the toner cartridge installation unit 106 such that the longitudinal direction corresponds to the horizontal direction. The rotation mechanism (e.g., gear) of the toner cartridge 106, for example, causes the toner cartridge 200 to rotate about the horizontal axis.

Image Forming Apparatus, Image Forming Method

An image forming apparatus according to an exemplary embodiment includes: an image holding member; a charging unit that charges a surface of the image holding member; an electrostatic charge image forming unit that forms an electrostatic charge image on the charged surface of the image holding member; a developing unit that contains an electrostatic charge image developer and develops an electrostatic charge image on the surface of the image holding member by using the electrostatic charge image developer to form a toner image; a transfer unit that transfers the toner image on the surface of the image holding member onto a surface of a recording medium; a fixing unit that fixes the toner image that has been transferred onto the surface of the recording medium; a replenishment toner container that contains the electrostatic charge image development toner according to this exemplary embodiment as a replenishment toner with which the developing unit is to be replenished; and a toner replenishment path that connects between the replenishment toner container and the developing unit and through which the developing unit is replenished with the electrostatic charge image development toner in the replenishment toner container.

An image forming method (an image forming method according to an exemplary embodiment) is carried out in the image forming apparatus according to the exemplary embodiment. The image forming method includes: a charging step of charging a surface of an image holding member; an electrostatic charge image forming step of forming an electrostatic charge image on the charged surface of the image holding member; a developing step of developing the electrostatic charge image on the surface of the image holding member by using the electrostatic charge image developer according to the exemplary embodiment to form a toner image; a transferring step of transferring the toner image on the surface of the image holding member onto a surface of a recording medium; a fixing step of fixing the toner image that has been transferred onto the surface of the recording medium; and a toner replenishing step of replenishing a developing unit with the electrostatic charge image development toner according to the exemplary embodiment in a replenishment toner container from the replenishment toner container containing the electrostatic charge image development toner through a toner replenishment path that connects between the replenishment toner container and the developing unit.

The image forming apparatus according to this exemplary embodiment may be a known image forming apparatus, such as a direct transfer-type apparatus in which a toner image formed on the surface of an image holding member is directly transferred onto a recording medium; an intermediate transfer-type apparatus in which a toner image formed on the surface of an image holding member is firstly transferred onto the surface of an intermediate transfer body, and the toner image, which has been transferred onto the surface of the intermediate transfer medium, is secondarily transferred onto the surface of a recording medium; an apparatus including a cleaning unit that cleans the surface of an image holding member before charging after transfer of a toner image; and an apparatus including a charge eliminating unit that eliminates charges by irradiating the surface of an image holding member with charge eliminating light before charging after transfer of a toner image.

In the case where the image forming apparatus according to this exemplary embodiment is an intermediate transfer-type apparatus, the transfer unit includes, for example, an intermediate transfer body having the surface onto which a toner image is transferred, a first transfer unit that firstly transfers the toner image on the surface of the image holding member onto the surface of the intermediate transfer body, and a second transfer unit that secondarily transfers the toner image, which has been transferred onto the surface of the intermediate transfer body, onto the surface of a recording medium.

In the image forming apparatus according to this exemplary embodiment, a section including the developing unit may have a cartridge structure (process cartridge) that is attachable to and detachable from the image forming apparatus. The process cartridge may be, for example, a process cartridge that contains the electrostatic charge image developer according to this exemplary embodiment and that includes a developing unit.

An example of the image forming apparatus according to this exemplary embodiment will be described below, but the image forming apparatus is not limited to this example. In the following description, the main parts shown in the figure are described, and the description of other parts is omitted.

Figure 3:
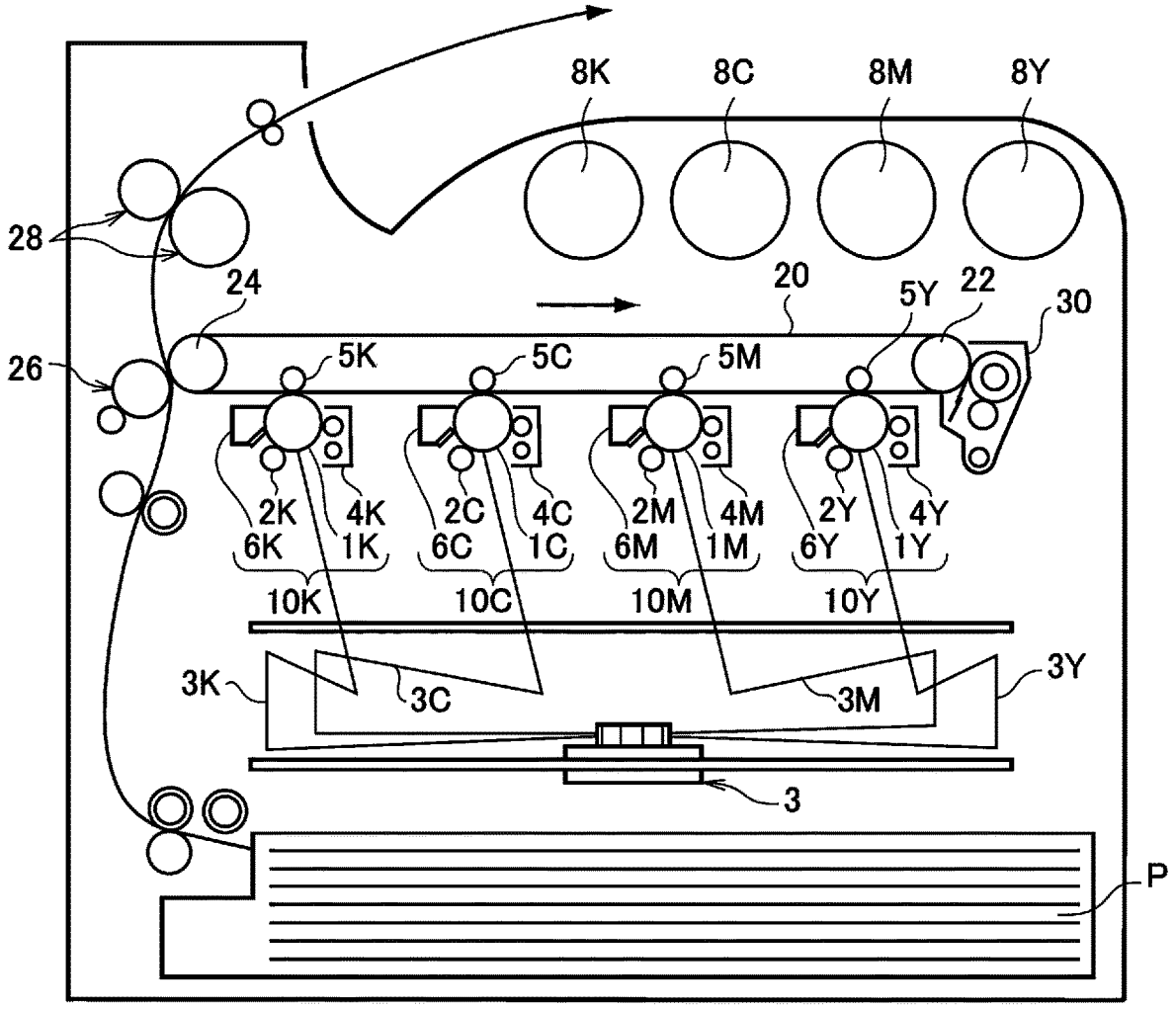
FIG. 3 is a schematic view of an example image forming apparatus according to an exemplary embodiment.

FIG. 3 is a schematic view of the image forming apparatus according to this exemplary embodiment.

The image forming apparatus shown in FIG. 3 includes first to fourth electrophotographic image forming units 10Y, 10M, 10C, and 10K (image forming units), which respectively output yellow (Y), magenta (M), cyan (C), and black (K) color images based on color-separated image data. The image forming units (hereinafter may also be referred to simply as "units") 10Y, 10M, 10C, and 10K are arranged and spaced apart from each other at predetermined intervals in the horizontal direction. The units 10Y, 10M, 10C, and 10K may be process cartridges that are attachable to and detachable from the image forming apparatus.

An intermediate transfer belt (an example of the intermediate transfer body) 20 is located above and in upper parts of the units 10Y, 10M, 10C, and 10K. The intermediate transfer belt 20 extends so as to pass through the units 10Y, 10M, 10C, and 10K. The intermediate transfer belt 20 is wound around a drive roller 22 and a support roller 24 and runs in the direction from the first unit 10Y toward the fourth unit 10K. The support roller 24 undergoes a force in a direction away from the drive roller 22 by means of a spring or the like (not shown), so that tension is applied to the intermediate transfer belt 20 wound around both the support roller 24 and the drive roller 22. An intermediate transfer body cleaning device 30 is disposed at the image holding member-side surface of the intermediate transfer belt 20 so as to face the drive roller 22.

The image forming apparatus shown in FIG. 3 has detachable toner cartridges 8Y, 8M, 8C, and 8K, which are example replenishment toner containers. Developing devices 4Y, 4M, 4C, and 4K of the units 10Y, 10M, 10C, and 10K are respectively connected to the toner cartridges 8Y, 8M, 8C, and 8K through toner replenishment paths (not shown). The developing devices 4Y, 4M, 4C, and 4K are replenished with the respective color toners from the toner cartridges 8Y, 8M, 8C, and 8K through toner replenishment paths. When the toner contained in the toner cartridges runs short, the toner cartridges are replaced.

Since the first to fourth units 10Y, 10M, 10C, and 10K have the same structure and operate in the same manner, the first unit 10Y disposed upstream in the running direction of the intermediate transfer belt to form a yellow image will be described as a representative example.

The first unit 10Y has a photoreceptor 1Y, which functions as an image holding member. The photoreceptor 1Y is surrounded by, in sequence, a charging roller (an example of the charging unit) 2Y, which charges the surface of the photoreceptor 1Y to a predetermined potential, an exposure device (an example of the electrostatic charge image forming unit) 3, which exposes the charged surface to a laser beam 3Y based on a color-separated image signal to form an electrostatic charge image, a developing device (an example of the developing unit) 4Y, which supplies charged toner to the electrostatic charge image to develop the electrostatic charge image, a first transfer roller 5Y (an example of the first transfer unit), which transfers the developed toner image onto the intermediate transfer belt 20, and a photoreceptor cleaning device (an example of the cleaning unit) 6Y, which removes residual toner from the surface of the photoreceptor 1Y after the first transfer.

The first transfer roller 5Y is disposed on the inner side of the intermediate transfer belt 20 so as to face the photoreceptor 1Y. The first transfer rollers 5Y, 5M, 5C, and 5K in the units are connected to the respective bias power supplies (not shown) that apply a first transfer bias. The transfer bias applied by each bias power supply to the corresponding first transfer roller changes under the control of a controller (not shown).

The operation of the first unit 10Y in forming a yellow image will be described below.

Before operation, the charging roller 2Y charges the surface of the photoreceptor 1Y to a potential of −600 V to −800 V.

The photoreceptor 1Y includes a conductive substrate (e.g., a volume resistivity of $1\times10^{-6}$ Ωcm or less at 20° C.) and a photosensitive layer stacked on the substrate. The photosensitive layer normally has high resistance (comparable to the resistance of common resins), but irradiation with a laser beam changes the specific resistance of a region of the photosensitive layer irradiated with the laser beam. For this, the charged surface of the photoreceptor 1Y is irradiated with the laser beam 3Y from the exposure device 3 in accordance with yellow image data sent from the controller (not shown). As a result, an electrostatic charge image with a yellow image pattern is formed on the surface of the photoreceptor 1Y.

The electrostatic charge image is an image formed on the surface of the photoreceptor 1Y by means of charging. Specifically, the electrostatic charge image is so-called a negative latent image formed such that the specific resistance of a region of the photosensitive layer irradiated with the laser beam 3Y drops to cause flow of charges on the surface of the photoreceptor 1Y while charges in a region that is not irradiated with the laser beam 3Y remain.

The electrostatic charge image formed on the photoreceptor 1Y rotates up to a predetermined developing position as the photoreceptor 1Y runs. The electrostatic charge image on the photoreceptor 1Y is developed and visualized by the developing device 4Y to form a toner image at this developing position.

The developing device 4Y contains, for example, an electrostatic charge image developer containing at least yellow toner and a carrier. The yellow toner is triboelectrically charged upon being stirred inside the developing device 4Y so as to have charges with the same polarity (negative polarity) as charges on the photoreceptor 1Y. The yellow toner is held on a developer roller (an example of a developer holding member). As the surface of the photoreceptor 1Y passes through the developing device 4Y, the yellow toner electrostatically adheres to charge-eliminated latent image areas on the surface of the photoreceptor 1Y, whereby the latent image is developed with the yellow toner. The photoreceptor 1Y having the yellow toner image formed thereon subsequently runs at a predetermined rate, and the toner image developed on the photoreceptor 1Y is transported to a predetermined first transfer position.

When the yellow toner image on the photoreceptor 1Y is transported to the first transfer position, a first transfer bias is applied to the first transfer roller 5Y, an electrostatic force from the photoreceptor 1Y toward the first transfer roller 5Y acts on the toner image, and the toner image on the photoreceptor 1Y is transferred onto the intermediate transfer belt 20. The transfer bias applied at this time has polarity (+) opposite to the polarity (−) of the toner. The transfer bias is controlled at, for example, +10 μA in the first unit 10Y by the controller (not shown).

The toner remaining on the photoreceptor 1Y is removed and collected by the photoreceptor cleaning device 6Y.

The first transfer biases applied to the first transfer rollers 5M, 5C, and 5K in the second unit 10M and the subsequent units are also controlled in the same manner as in the first unit.

Accordingly, the intermediate transfer belt 20 onto which the yellow toner image has been transferred in the first unit 10Y is transported through the second to fourth units 10M, 10C, and 10K, and the toner images of respective colors are multiply transferred in a superimposed manner.

The intermediate transfer belt 20 onto which the four color toner images have been multiply transferred through the first to fourth units reaches a second transfer section. The second transfer section includes the intermediate transfer belt 20, the support roller 24 in contact with the inner surface of the intermediate transfer belt, and a second transfer roller (an example of the second transfer unit) 26 disposed adjacent to the image holding surface of the intermediate transfer belt 20. A sheet of recording paper (an example of the recording medium) P is fed to a gap between the second transfer roller 26 and the intermediate transfer belt 20 through a feeding mechanism at a predetermined timing, and a second transfer bias is applied to the support roller 24. The transfer bias applied at this time has the same polarity (−) as the polarity (−) of the toner. An electrostatic force from the intermediate transfer belt 20 toward the sheet of recording paper P acts on the toner image, whereby the toner image on the intermediate transfer belt 20 is transferred onto the sheet of recording paper P. The second transfer bias in this case is determined on the basis of the resistance detected by a resistance detector (not shown) that detects the resistance of the second transfer section. The voltage for the second transfer bias is controlled.

The sheet of recording paper P is then conveyed to a pressure contact part (nip part) between a pair of fixing rollers in a fixing device (an example of the fixing unit) 28. The toner image is thus fixed to the sheet of recording paper P to form a fixed image.

Examples of the recording paper P onto which a toner image is transferred include plain paper used in electrophotographic copiers, printers, and the like. Examples of the recording medium include OHP sheets, in addition to the recording paper P.

To improve the smoothness of the image surface after fixing, the recording paper P may have a smooth surface and may be, for example, coated paper obtained by coating the surface of plain paper with resin or the like, art paper for printing, or the like.

The sheet of recording paper P to which the color image has been fixed is discharged to a discharge part, and a series of color image forming operations are completed.

EXAMPLES

Exemplary embodiments of the present disclosure will be described below in detail by way of Examples, but exemplary embodiments of the present disclosure are not limited to these Examples. In the following description, the units "part" and "%" are on a mass basis, unless otherwise specified.

Preparation of Toner Particles (1)

Preparation of Amorphous Polyester Resin Dispersion (A1)

Terephthalic acid: 70 parts
Fumaric acid: 30 parts
Ethylene glycol: 44 parts
1,5-Pentanediol: 46 parts These materials are placed in a flask equipped with a stirrer, a nitrogen inlet tube, a temperature sensor, and a fractionating column. The mixture is heated to 210° C. over 1 hour under nitrogen gas flow. Titanium tetrabutoxide is added in an amount of 1 part per 100 parts of the total of the above materials. While generated water is distilled off, the mixture is heated to 240° C. over 0.5 hours, and the dehydration condensation reaction continues at 240° C. for 1 hour. The reaction product is then cooled. An amorphous polyester resin having a weight-average molecular weight of 94500 and a glass transition temperature of 61° C. is produced accordingly.

In a container equipped with a temperature controlling unit and a nitrogen purging unit, 40 parts of ethyl acetate and 25 parts of 2-butanol are placed to form a solvent mixture. The amorphous polyester resin (100 parts) is gradually added to and dissolved in the solvent mixture. A 10% aqueous ammonia solution (in an amount corresponding to three times the acid value of the resin by molar ratio) is added to the solution, and the mixture is stirred for 30 minutes. Next, the container is purged with dry nitrogen and held at 40° C. To the mixture, 400 parts of ion exchange water is added dropwise under stirring to cause emulsification. After completion of dropwise addition, the emulsion is returned to 25° C. A resin particle dispersion in which resin particles having a volume-average particle diameter of 210 nm are dispersed is obtained accordingly.

The solids content of the resin particle dispersion is adjusted to 20% by addition of ion exchange water to provide an amorphous polyester resin dispersion (A1).

Preparation of Crystalline Polyester Resin Dispersion (B1)

Dimethyl sebacate: 97 parts
Sodium dimethyl 5-sulphonatoisophthalate: 3 parts
Ethylene glycol: 100 parts
Dibutyltin oxide (catalyst): 0.3 parts These materials are placed in a heat-dried three-necked flask, and the air in the three-necked flask is converted into an inert atmosphere by replacement with nitrogen gas. The mixture is stirred and refluxed at 180° C. for 5 hours by machinery stirring. Next, the mixture is then gradually heated to 240° C. under reduced pressure and stirred for 2 hours. The mixture is then air-cooled to terminate the reaction when the mixture becomes viscous. A crystalline polyester resin having a weight-average molecular weight of 9700 and a melting temperature of 84° C. is produced accordingly.

A mixture of 90 parts of the crystalline polyester resin, 1.8 parts of an anionic surfactant (Neogen RK available from DKS Co. Ltd.), and 210 parts of ion exchange water is heated to 100° C. The mixture is processed into a dispersion by using a homogenizer (ULTRA-TURRAX T50 available from IKA) and then subjected to a dispersion treatment with a pressure discharge Gaulin homogenizer for 1 hour to form a resin particle dispersion in which resin particles having a volume-average particle diameter of 205 nm are dispersed. The solids content of the resin particle dispersion is adjusted to 20% by addition of ion exchange water to provide a crystalline polyester resin dispersion (B1).

Preparation of Release Agent Particle Dispersion (W1)

Paraffin wax (HNP-9 available from Nippon Seiro Co., Ltd.): 100 parts
Anionic surfactant (Neogen RK available from DKS Co. Ltd.): 1 part
Ion exchange water: 350 parts These materials are mixed and heated to 100° C. The mixture is processed into a dispersion by using a homogenizer (ULTRA-TURRAX T50 available from IKA) and then subjected to a dispersion treatment with a pressure discharge Gaulin homogenizer to form a release agent particle dispersion in which release agent particles having a volume-average particle diameter of 200 nm are dispersed. The solids content of the release agent particle dispersion is adjusted to 20% by addition of ion exchange water to form a release agent particle dispersion (W1).

Preparation of Coloring Agent Particle Dispersion (K1)

Carbon black (Regal 330 available from Cabot Corporation): 50 parts
Ionic surfactant Neogen RK (available from DKS Co. Ltd.): 5 parts
Ion exchange water: 195 parts These materials are mixed and subjected to a dispersion treatment by using Ultimizer (available from Sugino Machine Limited) at 240 MPa for 10 minutes to form a coloring agent particle dispersion (K1) with 20% solids content.

Preparation of Toner Particles

Ion exchange water: 200 parts
Amorphous polyester resin dispersion (A1): 150 parts
Crystalline polyester resin dispersion (B1): 10 parts
Release agent particle dispersion (W1): 10 parts
Coloring agent particle dispersion (K1): 15 parts
Anionic surfactant (TaycaPower): 2.8 parts These materials are placed in a round stainless steel flask. The pH of the mixture is adjusted to 3.5 by addition of 0.1N nitric acid, and a polyaluminum chloride aqueous solution of 2 parts of polyaluminum chloride (available from Oji Paper Co., Ltd., 30% powder product) in 30 parts of ion exchange water is then added. The mixture is processed into a dispersion at 30° C. by using a homogenizer (ULTRA-TURRAX T50 available from IKA), and the dispersion is then heated to 45° C. in a heating oil bath and held until the volume-average particle diameter reaches 4.9 μm. Next, 60 parts of the amorphous polyester resin dispersion (A1) is added and the mixture is held for 30 minutes. Next, 60 parts of the amorphous polyester resin dispersion (A1) is further added when the volume-average particle diameter reaches 5.2 μm, and the mixture is held for 30 minutes. Subsequently, 20 parts of 10% nitrilotriacetic acid (NTA) metal salt aqueous solution (Chelest 70 available from Chelest Corporation) is added, and the pH of the mixture is then adjusted to 9.0 by addition of 1N sodium hydroxide aqueous solution. Next, 1 part of anionic surfactant (TaycaPower) is added, and the mixture is heated to 85° C. under stirring and held for 5 hours. Subsequently, the mixture is cooled to 20° C. at a rate of 20° C./min. Next, the mixture is filtered, washed well with ion exchange water, and dried to form toner particles (1) having a volume-average particle diameter of 5.7 μm and an average circularity of 0.971.

Preparation of Toner Particles (2) to (5)

Toner particles (2) to (5) having different volume-average particle diameters are produced in the same manner as the manufacture of the toner particles (1) except that the holding time in the fusion-coalescence step is changed.

- Toner particles (2): volume-average particle diameter 4.7 μm
- Toner particles (3): volume-average particle diameter 8.9 μm
- Toner particles (4): volume-average particle diameter 3.7 μm
- Toner particles (5): volume-average particle diameter 9.1 μm Preparation of Melamine Cyanurate Particles (1) to (5)

Commercially available melamine cyanurate (MC-4500 available from Nissan Chemical Corporation) is pulverized and sized in a jet mill to produce the following melamine cyanurate particles (1) to (5). In Table 1, "MC" denotes melamine cyanurate.

- Melamine cyanurate particles (1): volume-average particle diameter 0.7 μm
- Melamine cyanurate particles (2): volume-average particle diameter 0.4 μm
- Melamine cyanurate particles (3): volume-average particle diameter 2.9 μm
- Melamine cyanurate particles (4): volume-average particle diameter 0.3 μm
- Melamine cyanurate particles (5): volume-average particle diameter 3.1 μm Preparation of Carrier After 500 parts of spherical magnetite powder particles (volume-average particle diameter 0.55 μm) are stirred with a Henschel mixer, 5 parts of titanate coupling agent is added, and the mixture is heated to 100° C. and stirred for 30 minutes. Next, 6.25 parts of phenol, 9.25 parts of 35% formalin, 500 parts of titanate coupling agent-treated magnetite particles, 6.25 parts of 25% ammonia water, and 425 parts of water are placed in a four-necked flask and stirred. The mixture is caused to react under stirring at 85° C. for 120 minutes and then cooled to 25° C. After addition of 500 parts of water, the supernatant is removed, and the precipitate is washed with water. The water-washed precipitate is heat-dried under reduced pressure to provide a carrier having an average particle diameter of 35 μm.

Example 1

In a sample mill, 100 parts of toner particles (1), 1.6 parts of hexamethyldisilazane-hydrophobized silica particles (RX200 available from Nippon Aerosil Co., Ltd.), and melamine cyanurate particles (1) in the amount (mass %) described in Table 1 are placed and mixed at 10000 rpm for 30 seconds. The mixture is then screened through a vibrating screen with a mesh size of 45 μm to prepare a toner having a volume-average particle diameter of 5.7 μm.

The toner and the carrier are placed in a V-blender at a ratio of toner:carrier=5:95 (mass ratio) and stirred for 20 minutes to provide a developer.

Examples 2 to 7 and Comparative Examples 1 to 4

Toners and developers are produced in the same manner as in Example 1 except that the type of toner particles or the type of layered-structure compound particles and the addition amount are changed.

Performance Evaluation

Toner Remaining Amount

A rotary toner bottle (made of polyethylene terephthalate) in the form shown in FIG. 1 is provided. The rotary toner bottle is charged with 310 g of toner, installed into a replenishing device having a transport nozzle (replenishing device that replenishes a toner storage container with toner from a toner cartridge), and placed in a room at a temperature of 28° C. and a relative humidity of 85% for 17 hours to control temperature and humidity. Subsequently, the temperature and humidity of the room are changed to a temperature of 22° C. and a relative humidity of 15%. Under this environment, the rotary toner bottle is rotated at a rate of 30 rpm, and a transport screw in a toner replenishment path is driven simultaneously. The conditions of the rotation of the toner storage container and the operation of the replenishing device are as described below.

Number of rotation of toner storage container: 30 rpm
Length of transport nozzle of replenishing device: 70 mm
Screw pitch in transport path: 12.5 mm
Outer diameter of transport screw: 10 mm
Shaft diameter of transport screw: 4 mm
Number of rotations of transport screw: 62.4 rpm The toner remaining amounts (g) in the toner bottle at 50 minutes after operation start are classified into G1 to G4 described below.

G1: Less than 15 g (acceptable in practical use)
G2: 15 g or more and less than 30 g (acceptable in practical use)
G3: 30 g or more and less than 50 g (acceptable in practical use)
G4: 50 g or more (not acceptable in practical use)

Nitrogen Amount on Toner Bottle Inner Wall

The toner in the toner bottle is discharged by gently tilting the toner bottle after the evaluation. The nitrogen amount (M) on the toner bottle inner wall is analyzed by XPS in the following procedure.

The adhering matter on the toner bottle inner wall is subjected to elemental analysis by using an X-ray photoelectron spectrometer (JPS-9000MX available from JEOL Ltd.) with a Mg Kα ray as an X-ray source at an acceleration voltage of 10 kV and an emission current of 20 mA. The elements of interest are carbon (C), nitrogen (N), and oxygen (O), and the abundance % of each element is calculated from the total abundance (atom %) of measured elements.

G1: The abundance of N is less than 20%.

G2: The abundance of N is 20% or more and less than 60%.

G3: The abundance of N is 60% or more.

The nitrogen amount on the toner bottle inner wall indicates the lubrication effect of the melamine cyanurate particles. The adhesion of an appropriate amount of nitrogen (i.e., melamine cyanurate particles) to the toner bottle inner wall means a possibility that the melamine cyanurate particles function as a lubricant between the toner and the toner bottle inner wall. The adhesion of an excessive amount of nitrogen (i.e., melamine cyanurate particles) to the toner bottle inner wall means a possibility that the melamine cyanurate particles are detached from the toner and fail to exhibit an expected lubrication effect between toner particles and between the toner and the toner bottle inner wall.

TABLE 1

| | Toner Particles | | Layered-Structure Compound Particles | | | | | Performance Evaluation | |
|---|---|---|---|---|---|---|---|---|---|
| | No. | Volume-Average Particle Diameter Db (μm) | No. | Compound | Volume-Average Particle Diameter Da (μm) | Amount (mass %) relative to entire toner | Particle Diameter Ratio Da/Db | Toner Remaining Amount | Nitrogen Amount on Bottle Inner Wall |
| Comparative Example 1 | (1) | 5.7 | (4) | MC | 0.3 | 0.10 | 0.053 | G4 | G2 |
| Comparative Example 2 | (1) | 5.7 | (5) | MC | 3.1 | 0.10 | 0.544 | G4 | G3 |
| Comparative Example 3 | (5) | 9.1 | (4) | MC | 0.3 | 0.10 | 0.033 | G4 | G2 |
| Comparative Example 4 | (4) | 3.7 | (5) | MC | 3.1 | 0.10 | 0.838 | G4 | G3 |
| Example 1 | (1) | 5.7 | (1) | MC | 0.7 | 0.10 | 0.123 | G1 | G1 |
| Example 2 | (1) | 5.7 | (2) | MC | 0.4 | 0.10 | 0.070 | G2 | G1 |
| Example 3 | (1) | 5.7 | (3) | MC | 2.9 | 0.10 | 0.509 | G1 | G2 |
| Example 4 | (3) | 8.9 | (2) | MC | 0.4 | 0.10 | 0.045 | G3 | G1 |
| Example 5 | (2) | 4.7 | (3) | MC | 2.9 | 0.10 | 0.617 | G2 | G2 |
| Example 6 | (1) | 5.7 | (1) | MC | 0.7 | 0.02 | 0.123 | G2 | G1 |
| Example 7 | (1) | 5.7 | (1) | MC | 0.7 | 1.00 | 0.123 | G1 | G2 |

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An electrostatic charge image development toner that is negatively chargeable, comprising:

toner particles; and layered-structure compound particles, wherein the layered-structure compound particles have a volume-average particle diameter Da of 0.4 μm or more and less than 3.0 μm, and a ratio Da/Db of the volume-average particle diameter Da of the layered-structure compound particles to a volume-average particle diameter Db of the toner particles is 0.044 or more and 0.625 or less.

2. The electrostatic charge image development toner according to claim 1, wherein the toner particles have a volume-average particle diameter Db of 4 μm or more and 9 μm or less.

3. The electrostatic charge image development toner according to claim 2, wherein an amount of the layered-structure compound particles is 0.01 mass % or more and 1.0 mass % or less relative to the entire electrostatic charge image development toner.

4. The electrostatic charge image development toner according to claim 3, wherein the ratio Da/Db of the volume-average particle diameter Da of the layered-structure compound particles to the volume-average particle diameter Db of the toner particles is 0.056 or more and 0.580 or less.

5. The electrostatic charge image development toner according to claim 2, wherein the ratio Da/DU of the volume-average particle diameter Da of the layered-structure compound particles to the volume-average particle diameter Db of the toner particles is 0.056 or more and 0.580 or less.

6. The electrostatic charge image development toner according to claim 2, wherein the layered-structure compound particles have a volume-average particle diameter Da of 0.45 μm or more and 2.7 μm or less.

7. The electrostatic charge image development toner according to claim 2, wherein the toner particles have a volume-average particle diameter Db of 4 μm or more and 8 μm or less.

8. The electrostatic charge image development toner according to claim 1, wherein an amount of the layered-structure compound particles is 0.01 mass % or more and 1.0 mass % or less relative to the entire electrostatic charge image development toner.

9. The electrostatic charge image development toner according to claim 8, wherein the amount of the layered-structure compound particles is 0.01 mass % or more and 0.90 mass % or less relative to the entire electrostatic charge image development toner.

10. The electrostatic charge image development toner according to claim 8, wherein the layered-structure compound particles have a volume-average particle diameter Da of 0.45 μm or more and 2.7 μm or less.

11. The electrostatic charge image development toner according to claim 8, wherein the ratio Da/Db of the volume-average particle diameter Da of the layered-structure compound particles to the volume-average particle diameter Db of the toner particles is 0.056 or more and 0.580 or less.

12. The electrostatic charge image development toner according to claim 1, wherein the ratio Da/Db of the volume-average particle diameter Da of the layered-structure compound particles to the volume-average particle diameter Db of the toner particles is 0.056 or more and 0.580 or less.

13. The electrostatic charge image development toner according to claim 1, wherein the layered-structure compound particles have a volume-average particle diameter Da of 0.45 μm or more and 2.7 μm or less.

14. The electrostatic charge image development toner according to claim 1, wherein the layered-structure compound particles contain at least one type of particles selected from the group consisting of melamine cyanurate particles, boron nitride particles, graphite fluoride particles, molybdenum disulfide particles, and mica particles.

15. An electrostatic charge image developer comprising the electrostatic charge image development toner according to claim 1.

16. A toner cartridge attachable to and detachable from an image forming apparatus, the toner cartridge comprising the electrostatic charge image development toner according to claim 1.

17. The toner cartridge according to claim 16, wherein the toner cartridge is a rotary toner cartridge having a rotary body containing the electrostatic charge image development toner.

18. A process cartridge attachable to and detachable from an image forming apparatus, the process cartridge comprising:

a developing unit that contains an electrostatic charge image developer and develops an electrostatic charge image on a surface of an image holding member by using the electrostatic charge image developer to form a toner image;

a toner cartridge that contains the electrostatic charge image development toner according to claim 1; and a toner replenishment path that connects between the toner cartridge and the developing unit and through which the developing unit is replenished with the electrostatic charge image development toner in the toner cartridge.

19. An image forming apparatus comprising:

an image holding member;

a charging unit that charges a surface of the image holding member;

an electrostatic charge image forming unit that forms an electrostatic charge image on the charged surface of the image holding member;

a developing unit that contains an electrostatic charge image developer and develops an electrostatic charge image on the surface of the image holding member by using the electrostatic charge image developer to form a toner image;

a transfer it that transfers the toner image on the surface of the image holding member onto a surface of a recording medium;

a fixing unit that fixes the toner image that has been transferred onto the surface of the recording medium;

a replenishment toner container that contains the electrostatic charge image development toner according to claim 1; and a toner replenishment path that connects between the replenishment toner container and the developing unit and through which the developing unit is replenished with the electrostatic charge image development toner in the replenishment toner container.

20. An image forming method comprising:

charging a surface of an image holding member;

forming an electrostatic charge image on the charged surface of the image holding member;

developing the electrostatic charge image on the surface of the image holding member by using an electrostatic charge image developer to form a toner image;

transferring the toner image on the surface of the image holding member onto a surface of a recording medium;

fixing the toner image that as been transferred onto the surface of the recording medium; and replenishing a developing unit with the electrostatic charge image development toner according to claim 1 in a replenishment toner container from the replenishment toner container containing the electrostatic charge image development toner through a toner replenishment path that connects between the replenishment toner container and the developing unit.

* * * * *